US008167566B2

(12) United States Patent
Howes

(10) Patent No.: US 8,167,566 B2
(45) Date of Patent: May 1, 2012

(54) ROTOR DOVETAIL HOOK-TO-HOOK FIT

(75) Inventor: James R. Howes, Hermon, ME (US)

(73) Assignee: General Electric Company, Schenectady, NY (US)

( * ) Notice: Subject to any disclaimer, the term of this patent is extended or adjusted under 35 U.S.C. 154(b) by 791 days.

(21) Appl. No.: 12/346,913

(22) Filed: Dec. 31, 2008

(65) Prior Publication Data

US 2010/0166557 A1 Jul. 1, 2010

(51) Int. Cl.
*B63H 1/20* (2006.01)
*B63H 13/00* (2006.01)

(52) U.S. Cl. ..... 416/219 R; 416/220 R

(58) Field of Classification Search ..... 416/219 R, 416/220 R

See application file for complete search history.

(56) References Cited

U.S. PATENT DOCUMENTS

| | | | | |
|---|---|---|---|---|
| 4,022,545 | A | 5/1977 | Shank | |
| 5,350,276 | A | 9/1994 | Gros | |
| 5,713,721 | A * | 2/1998 | Glynn et al. | 416/220 R |
| 5,749,706 | A * | 5/1998 | Maar | 416/220 R |
| 6,398,500 | B2 * | 6/2002 | Pedersen et al. | 416/220 R |
| 6,761,538 | B2 | 7/2004 | Fitts et al. | |
| 6,843,479 | B2 | 1/2005 | Burdgick | |
| 7,121,800 | B2 * | 10/2006 | Beattie | 416/190 |
| 7,128,535 | B2 | 10/2006 | Sucin et al. | |
| 8,011,892 | B2 * | 9/2011 | Ramlogan et al. | 416/190 |
| 2003/0044284 | A1 * | 3/2003 | Leeke et al. | 416/219 R |
| 2004/0086387 | A1 * | 5/2004 | Fitts et al. | 416/218 |
| 2005/0095129 | A1 * | 5/2005 | Benjamin et al. | 416/97 R |
| 2006/0056975 | A1 * | 3/2006 | Honkomp et al. | 416/193 A |
| 2009/0004013 | A1 * | 1/2009 | Ramlogan et al. | 416/190 |

* cited by examiner

*Primary Examiner* — Nitin Parekh
(74) *Attorney, Agent, or Firm* — Dority & Manning, P.A.

(57) ABSTRACT

A male dovetail for a bucket mounted on a drum rotor for a steam turbine is provided by a tight hook-to-hook fit with the female dovetail of a retaining groove around the periphery of the drum rotor wheel. The tight hook-to-hook fit eliminates the use of loading pins which heretofore have been driven between a base of the male dovetail and a bottom of the retaining groove, a manually intensive operation with the potential to damage the bucket and the rotor.

14 Claims, 4 Drawing Sheets

ROTOR DOVETAIL HOOK-TO-HOOK FIT

BACKGROUND OF THE INVENTION

The invention relates generally to steam turbines with drum rotors and more specifically to retention arrangements for buckets of steam turbines with drum rotors.

The current practice for radial loading of steam turbine reaction style buckets involves inserting a dovetailed portion for each bucket into a retaining groove in the steam turbine drum rotor, inserting a loading pin in a tightly controlled radial gap between a base of the retaining groove and a cutout in the bottom of the dovetailed portion, and then hammering the pin into the radial gap such that the pin deforms in the rotor radial direction and loads the bucket radially against a hook in the retaining groove.

For each bucket, there is a loading pin and each loading pin must be hammered manually until the bucket does not move in the rotor groove. This hammering operation, however, introduces an opportunity to damage the bucket as well as the rotor. As an example, for a 30-stage high pressure steam turbine approximately 2600 loading pins must be manually hammered to fasten the buckets radially in place.

FIG. 1 illustrates a representation of a portion of a steam turbine 5 including a drum rotor 24 mounting a plurality of circumferentially spaced buckets 10 about the periphery of the drum rotor 24, the drum rotor having an axis of rotation 7. The buckets 10 are arrayed in circumferentially extending female dovetail slots 26 in the drum rotor 24. A steam turbine casing 29 surrounds the drum rotor 24 and includes a plurality of nozzle segments 21 spaced circumferentially one from the other located in female dovetailed slots 27 in the casing 29.

FIG. 2 illustrates a first arrangement for maintaining radial loading on the root of the bucket being retained in the drum rotor. With reference to FIG. 2, a turbine bucket 10 includes an airfoil portion 12 and a root or base portion 14 that is configured as a male dovetail 16. The male dovetail includes radially outer and inner projections or hooks 18, 20 radially spaced by a narrow neck 22.

The drum rotor 24 is formed with an annular bucket retaining groove configured as a female dovetail slot 26 about the periphery of the wheel with a radially outer wide groove portion 28 for receiving the outer male projection 18, a radially inner wide groove portion 30 for receiving the inner male projection 20, and an intermediate narrow groove portion 32 for receiving the narrow neck 22. An undersurface 33 of the narrow groove portion 32 forms a so-called "hook" that is engaged by the inner projection 20 on the male dovetail 16.

A semicircular retaining groove 35 extends across undersurface 40 of male dovetail 16. When each bucket is loaded into female dovetail slot 26 about the periphery of the wheel, a solid semicircular pin 37 is manually hammered into the semicircular retaining groove 35 to bias the bucket in a radially outward direction, loading the bucket radially against the hook 33.

FIG. 3 illustrates an alternative arrangement for loading the bucket radially against hook 33. The alternative arrangement was described in U.S. Pat. No. 6,761,538 by Fitts et al. Corresponding parts of the female dovetail slot and male dovetail are similarly numbered as in FIG. 2. Within the base 34 of the female dovetail slot, there is formed an annular spring retaining groove 36 that extends completely about the periphery of the wheel. The groove itself extends substantially 180.degrees when viewed in cross-section (as in FIG. 1). A loading spring segment 38 is shown within the groove 36, radially interposed between the base 34 of the dovetail slot and the radially inner face 40 of the bucket dovetail. As indicated above, more than one groove 36 may be used, depending on the required radial loading on the buckets. The spring segment 38 biases the bucket in a radially outward direction, loading the bucket radially against the hook 33.

Traditional methods, and variations thereof, have been to essentially push the bucket outwards, radially, to ensure tight contact between the bucket load surface 33 and the rotor mating surface 39.

Accordingly, there is a need for an improved radial loading technique that provides parts reduction, rotor assembly time reduction, and consistent radial loading of the buckets against the rotor groove hook without danger of damage to the buckets and/or rotor.

BRIEF DESCRIPTION OF THE INVENTION

The present invention relates to an arrangement and method for positioning and retaining rotor dovetails with a hook-to-hook fit in a drum rotor for a steam turbine.

Briefly in accordance with one aspect of the present invention a loading arrangement adapted for radially loading turbine buckets on a drum rotor of a steam turbine is provided. The loading arrangement provides a drum rotor formed with an annular bucket retaining groove configured as a female dovetail slot about the periphery of a rotor wheel including a radially outer wide groove portion, a radially inner wide groove portion, and an intermediate narrow groove portion. Also provided is a root portion of a turbine bucket with a male dovetail including a radial inner projection and a radial outer projection, spaced by a narrow neck adapted for engaging the female dovetail slot. An undersurface of the narrow groove portion is adapted for engaging with an upper surface of inner projection formed on the male dovetail, adapted for retaining the male dovetail 16 within the female dovetail slot. An undersurface of radial outer projection of male dovetail closely engaging upper surface of radially outer wide groove portion is adapted for loading the bucket radially against the hook.

According to a second aspect of the present invention, a steam turbine drum rotor and bucket assembly is provided. The assembly includes a drum rotor formed with a bucket retaining groove about a periphery thereof and a plurality of buckets, each having a mounting portion including a radially inner face received within the bucket retaining groove. The assembly also includes an upper hook formed at an upper end of a narrowed portion of the bucket retaining groove, and a lower hook formed at a lower end of a narrowed portion of the bucket retaining groove. Also included in the assembly is the mounting portion of each of the plurality of buckets with a male dovetail including a radial inner projection and a radial outer projection, spaced by a narrow neck, adapted for engaging the bucket retaining groove, wherein the upper hook engages the radial outer projection and the lower hook engages the radial inner projection according to a designated loading clearance.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention have many advantages, including providing the bucket to drum rotor interface with a tighter controlled relationship, providing the benefit of reduced cost and complexity. Rather than utilizing loading pins between the drum rotor and the bucket dovetail, the buckets would be cut such that the clearances were maintained to achieve a minimum of movement from bucket to rotor. Instead of a loose fit, which is then overcome by adding an additional component to fill this gap, the bucket would be produced with a tight "hook-to-hook" fit, which would create the same desired result. Conceptually, this arrangement pulls or lifts the bucket outward radially onto the load surfaces, verses the traditional pushing or wedging outward methods.

This method allows for elimination of loading pins, a significant cost savings and ergonomic improvement to assembly. It also addresses backward compatibility with existing field units as this alternate design can be used on any retrofits or rebucketing. Additionally, it supports ongoing efforts to reduce variation in assembly and maintain consistent compaction of each row of buckets. Further, there is no change to the rotor wheel configuration or to stresses in either the bucket or the wheel. This configuration also allows for easy deviation of the dovetails to support serviceability.

Figure 2:
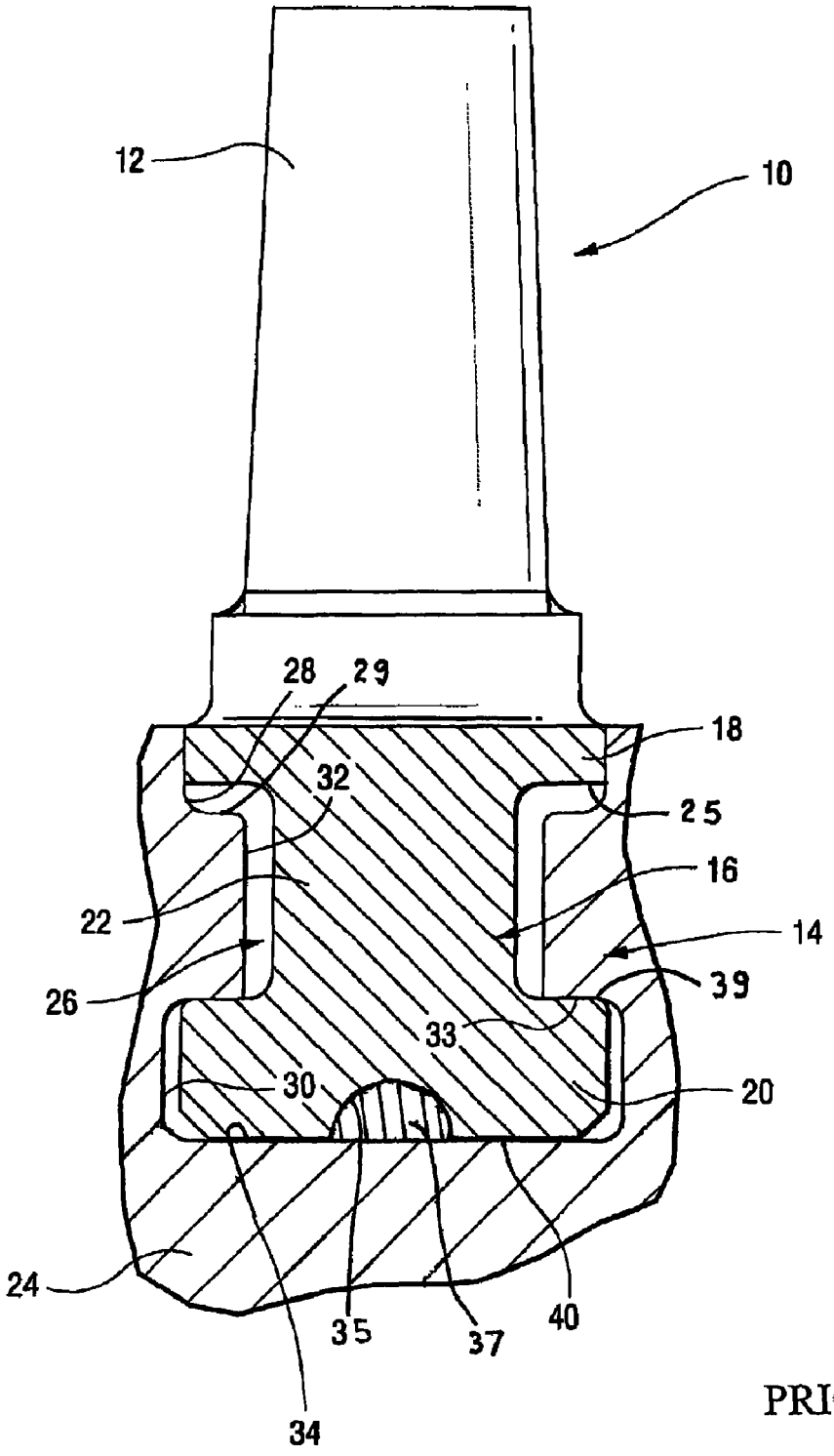
PRIOR ART Fig. 2
FIG. 2 illustrates a first arrangement for maintaining radial loading on the root of the bucket.
Figure 3:
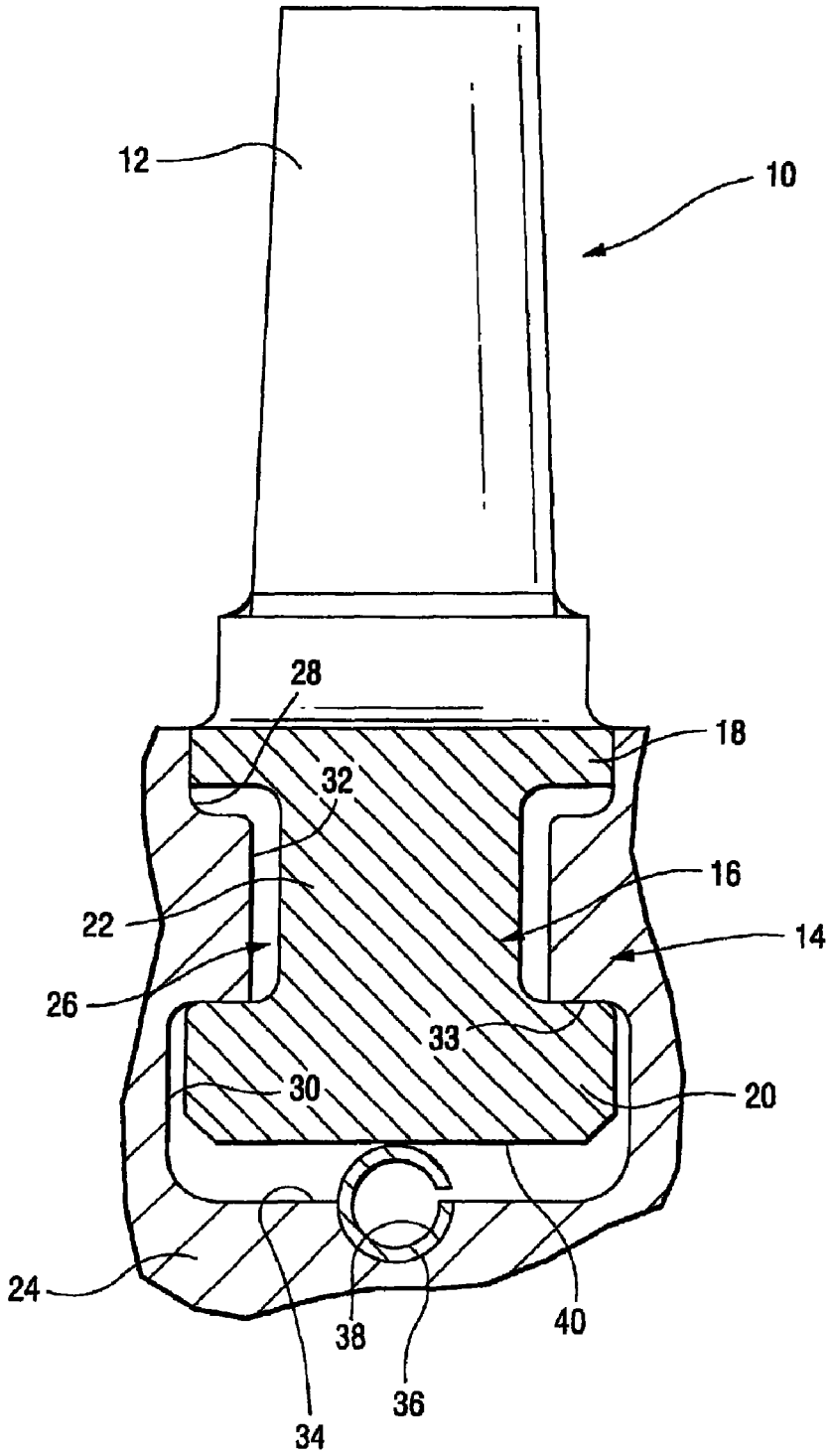
PRIOR ART Fig. 3
FIG. 3 illustrates an alternative arrangement for maintaining radial loading on the root of the bucket.
Figure 4:
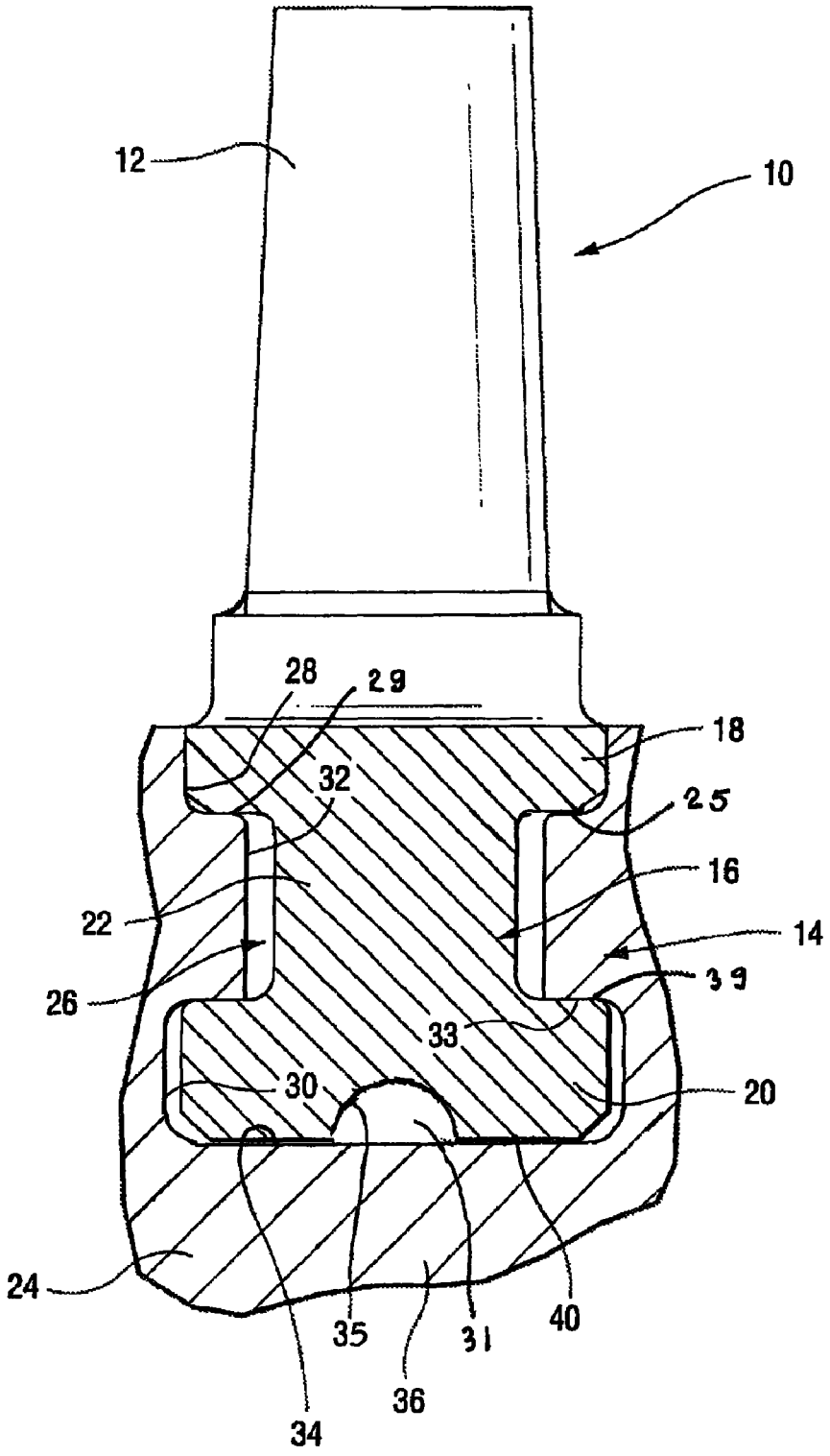
FIG. 4 illustrates an embodiment of the inventive retention arrangement for loading turbine buckets on a drum rotor of a steam turbine.

FIG. 4 illustrates an embodiment of the inventive retention arrangement for loading turbine buckets in a drum rotor for a steam turbine. Corresponding parts of the female dovetail slot and male dovetail are similarly numbered as in FIGS. 2-3.

Turbine bucket 10 includes an airfoil portion 12 and a root or base portion 14 that is configured as a male dovetail 16. The male dovetail 16 includes radially outer and inner projections or hooks 18, 20 radially spaced by a narrow neck 22. The drum rotor 24 is formed with an annular bucket retaining groove configured as a female dovetail slot 26 about the periphery of the wheel with a radially outer wide groove portion 28 for receiving the outer male projection 18, a radially inner wide groove portion 30 for receiving the inner male projection 20, and an intermediate narrow groove portion 32 for receiving the narrow neck 22. An undersurface 33 of the narrow groove portion 32 forms a so-called "hook" that is engaged by a top surface 39 of the inner projection 20 on the male dovetail 16.

Figure 1:
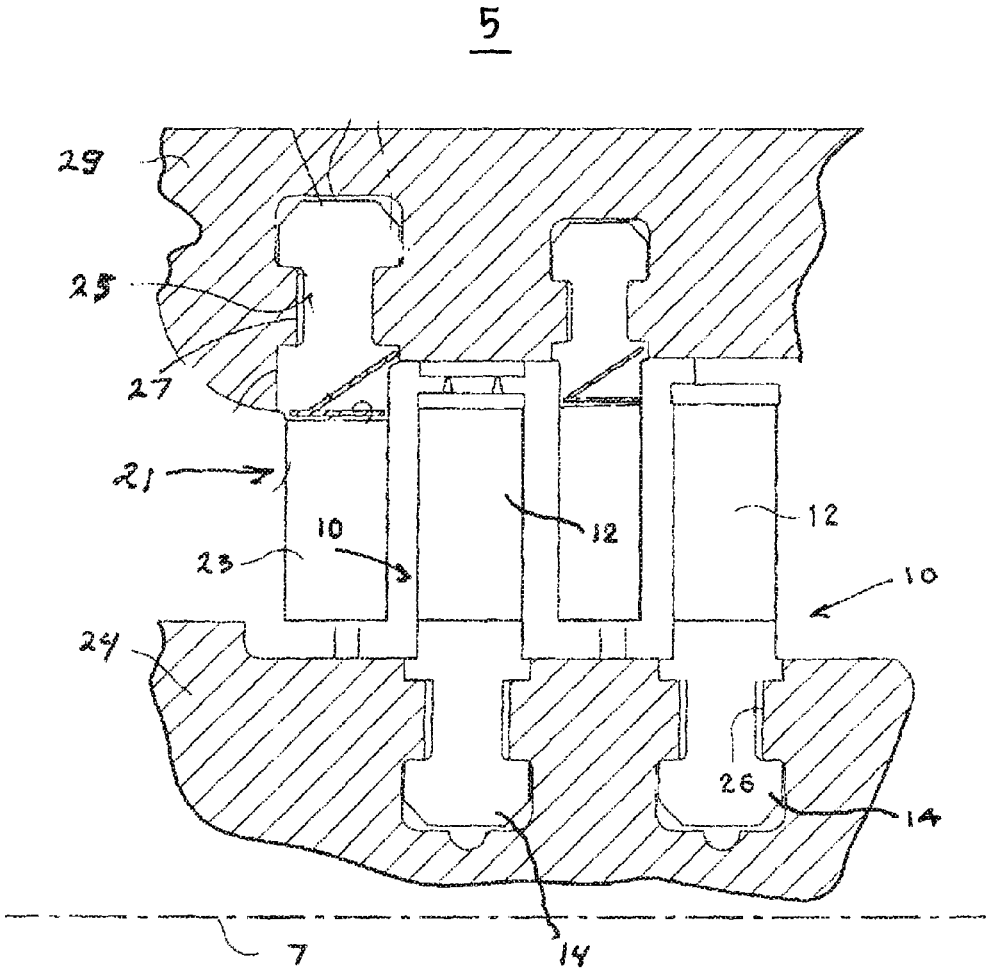
Fig. 1 PRIOR ART
FIG. 1 illustrates a representation of a portion of a steam turbine including a drum rotor mounting a plurality of circumferentially spaced buckets about the periphery of the drum rotor.

The underside 25 of outer male projection 18 is cut to establish a tight clearance with upper surface 29 of outer wide groove 28. Such a cut may provide a clearance of about 0.001 to 0.003 inch, eliminating the broad clearance shown in prior art FIG. 1 between corresponding parts. Bucket 10 is consequently retained tightly with a hook-to-hook fit by upper surface 25 of narrow groove 32 (hook) engaging the underside 25 of outer male projection 18 and by undersurface 33 of narrow groove 32 (hook) engaging the upper surface 39 of inner male projection 20. This tight retention arrangement obviates the need for a pin or spring to maintain male dovetail 16 vertically engaged.

As an artifact of prior loading on the bucket, semicircular cavity 31 may remain in the male dovetail 16, even though it is no longer required. For new or retrofit buckets, the semicircular cavity need not be provided as it no longer provides the loading function.

While various embodiments are described herein, it will be appreciated from the specification that various combinations of elements, variations or improvements therein may be made, and are within the scope of the invention.

The invention claimed is:

1. A loading arrangement adapted for radially loading steam turbine buckets on a drum rotor comprising:

a drum rotor of a steam turbine formed with an annular bucket retaining groove configured as a female dovetail slot about the periphery of the wheel including a radially outer wide groove portion, a radially inner wide groove portion, and an intermediate narrow groove portion;

a root portion of a steam turbine bucket with a male dovetail including a radial inner projection and a radial outer projection, spaced by a narrow neck adapted for engaging the female dovetail slot;

an undersurface of the narrow groove portion adapted for engaging with an upper surface of the radial inner projection formed on the male dovetail, adapted for retaining the male dovetail within the female dovetail slot; and an undersurface of the radial outer projection of the male dovetail closely engaging an upper surface of the radially outer wide groove portion, adapted for loading the bucket radially against the undersurface of the narrow groove portion, wherein the undersurface of the narrow groove portion is substantially parallel to the upper surface of the radially outer wide groove portion.

2. The loading arrangement adapted for radially loading steam turbine buckets according to claim 1, further comprising: a clearance of about 0.001 inch to about 0.003 inch between the undersurface of the radial outer projection of the male dovetail and the upper surface of the radially outer wide groove portion.

3. The loading arrangement adapted for radially loading steam turbine buckets according to claim 1, wherein a base of the male dovetail comprises a nominally flat surface.

4. The loading arrangement adapted for radially loading steam turbine buckets according to claim 1, wherein a base of the male dovetail comprises an arcuate-shaped cutout, centered on the base.

5. The loading arrangement adapted for radially loading steam turbine buckets according to claim 1, wherein the upper surface of the radial inner projection formed on the male dovetail is substantially parallel to the undersurface of the radial outer projection of the male dovetail.

6. The loading arrangement adapted for radially loading steam turbine buckets according to claim 1, wherein the narrow neck is substantially perpendicular to the upper surface of the radial inner projection formed on the male dovetail and the undersurface of the radial outer projection of the male dovetail.

7. The loading arrangement adapted for radially loading steam turbine buckets according to claim 1, where intermediate narrow groove portion is substantially perpendicular to the undersurface of the narrow groove portion and the upper surface of the radially outer wide groove portion.

8. A steam turbine rotor and bucket assembly comprising:

a drum rotor formed with a bucket retaining groove about a periphery thereof;

a plurality of buckets, each having a mounting portion including a radially inner face received within said bucket retaining groove;

an upper hook formed at an upper end of a narrowed portion of the bucket retaining groove;

a lower hook formed at a lower end of a narrowed portion of the bucket retaining groove, wherein the lower hook is substantially parallel to the upper hook;

the mounting portion of each of the plurality of buckets with a male dovetail including a radial inner projection and a radial outer projection, spaced by a narrow neck, adapted for engaging the bucket retaining groove, wherein the upper hook engages the radial outer projection and the lower hook engages the radial inner projection according to a designated loading clearance.

9. The steam turbine rotor and bucket assembly according to claim 8, further comprising: a designated clearance of about 0.001 inch to about 0.003 inch between the upper hook and the radial outer projection of the male dovetail.

10. The steam turbine rotor and bucket assembly according to claim 9, wherein a base of the male dovetail has a nominally flat surface.

11. The steam turbine rotor and bucket assembly according to claim 9, wherein a base of the male dovetail has an arcuate-shaped cutout, centered on the base.

12. The steam turbine rotor and bucket assembly according to claim 8, wherein the radial inner projection is substantially parallel to the radial outer projection.

13. The steam turbine rotor and bucket assembly according to claim 8, wherein the narrow neck is substantially perpendicular to the radial inner projection and the radial outer projection.

14. The steam turbine rotor and bucket assembly according to claim 8, wherein the narrowed portion of the bucket retaining groove is substantially perpendicular to the upper and lower hooks.

* * * * *